United States Patent [19]

Miyamura et al.

[11] Patent Number: 4,611,121

[45] Date of Patent: Sep. 9, 1986

[54] MAGNET APPARATUS

[75] Inventors: Masao Miyamura, Fujisawa; Osamu Tsukakoshi, Hiratsuka; Yoshio Kamata, Yokohama; Shoji Aiba, Nagoya, all of Japan

[73] Assignees: Nihon Shinku Gijutsu Kabushiki Kaisha, Chigasaki; Daido Tokushuko Kabushiki Kaisha, Nagoya, both of Japan

[21] Appl. No.: 601,410

[22] Filed: Apr. 18, 1984

[30] Foreign Application Priority Data

Apr. 19, 1983 [JP] Japan ..... 58-67865

[51] Int. Cl.[4] ..... H01J 27/16

[52] U.S. Cl. ..... 250/423 R; 313/361.1; 313/363.1; 313/231.41; 315/111.41; 315/111.81

[58] Field of Search ..... 313/361.1, 363.1, 231.41; 315/161, 111.81, 111.41; 219/121 P; 335/302; 250/423 R, 424, 396 ML

[56] References Cited

U.S. PATENT DOCUMENTS 2,503,173 4/1950 Reisner ..... 250/396 ML 4,393,333 7/1983 Sakudo et al. ..... 315/111.81

*Primary Examiner*—Bruce C. Anderson

*Assistant Examiner*—Jack I. Berman

*Attorney, Agent, or Firm*—Armstrong, Nikaido, Marmelstein & Kubovcik

[57] ABSTRACT

Magnet apparatus for providing a magnetic field having a gradient in an operation chamber comprising a cylindrical permanent magnet surrounding an outer periphery of the operation chamber and having opposite ends and a hollow interior, and a subsidiary yoke at one of the ends, the subsidiary yoke having a cylindrical portion extending into the hollow interior. The subsidiary yoke can include a flange portion. The cylindrical portion is inserted through the flange portion and fixed thereto with bolts. The permanent magnet can be made of Ba-ferrite, Sr-ferrite or the like.

8 Claims, 5 Drawing Figures

MAGNET APPARATUS

BACKGROUND OF THE INVENTION

This invention relates to a magnet apparatus used chiefly for an ion source for manufacturing of a semiconductor.

It has been proposed in recent years that a precision processing operation for manufacturing a semiconductor can be carried out by a reactive ion beam etching in order that a more precise product may be obtained with better control and less contamination. An ion source used for this precision operation is usually constructed, as show in FIG. 1. A vacuum electric discharging chamber a is charged with a reactive gas such as $CF_4$, $C_3F_8$, $C_4F_8$ or the like. The chamber is provided at its outer periphery with plural electromagnets b, b, so that ions thereof generated in the electric discharging chamber a by introduction of microwave thereinto are inducted, by means of an induction electrode c, towards a workpiece e provided in an adjacent treatment chamber d for etching the same.

It is necessary, in this case, that, in order to form an electron cyclotron resonance magnetic field in the electric discharge chamber, the plural electromagnets b, b, are controlled to produce a magnetic field having a gradient with an intensity larger on the microwave inlet opening side of the chamber a and smaller on the ion outlet opening side thereof as shown in FIG. 2. However, this arrangement is defective in that it is not always easy to control the electric current to each of the plural electromagnets b, b. A comparatively large capacity electric power source is required for achieving this control. Additionally, water-cooling thereof is required.

OBJECTS AND SUMMARY OF THE INVENTION

An object of the invention is to provide a magnet apparatus for producing a desired gradient in an operation chamber which is simple to control.

It is also an object to eliminate the comparatively large capacity electric power source and water cooling thereof needed in prior art devices.

These objects are obtained in a magnet apparatus for providing a magnetic field having a gradient in an operation chamber comprising a cylindrical permanent magnet surrounding an outer periphery of the operation chamber and having opposite ends and a hollow interior, and a subsidiary yoke at one of the ends, the subsidiary yoke having a cylindrical portion extending into the hollow interior.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF THE INVENTION

Figure 3:
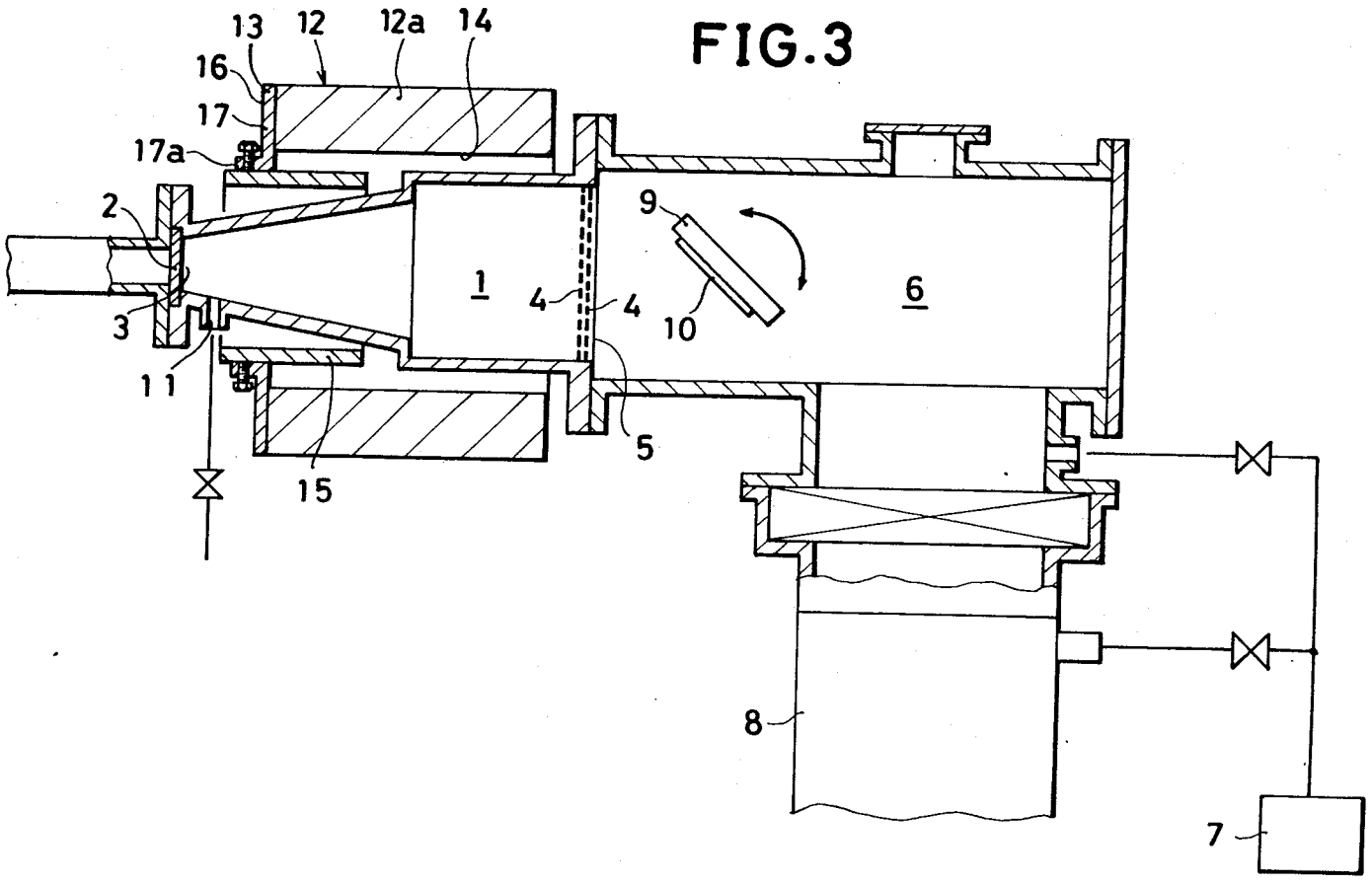
FIG. 3 is a sectional plan view of one embodying example of this invention.

One embodying example of this invention will be explained with reference to the accompanying drawings:

Referring to FIG. 3 showing the example adaptable for an ion source for manufacturing a semiconductor, an operation chamber 1 has an inlet opening 3 for introducing microwaves through a ceramic window 2 and an outlet opening 5 provided with two grid-form induction electrodes 4, 4 of about 500 V and 160 V. A treatment chamber 6 is provided adjacent to the outlet opening 5. The operation chamber 1 and the treatment chamber 6 are arranged to be evacuated by a rough vacuum pump 7 and a cryo pump 8. A work holder 9 for a workpiece 10 of an earth potential is tiltably provided in the treatment chamber 6. A charging opening 11 is provided for charging a reaction gas such as $CF_4$, $C_3F_8$, $C_4F_8$ or the like.

The foregoing construction is not especially different from that in the conventional example.

Figure 1:
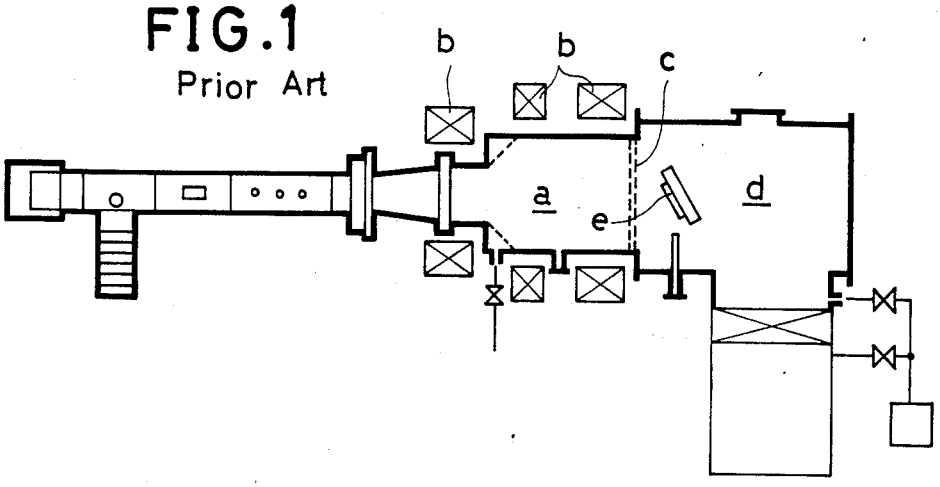
FIG. 1 Prior Art
FIG. 1 is an explanation diagram of a conventional example.
Figure 2:
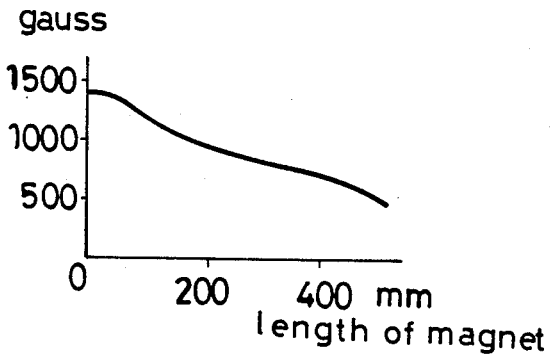
FIG. 2 is a diagram showing a magnetic field distribution characteristic curve thereof.
Figure 4:
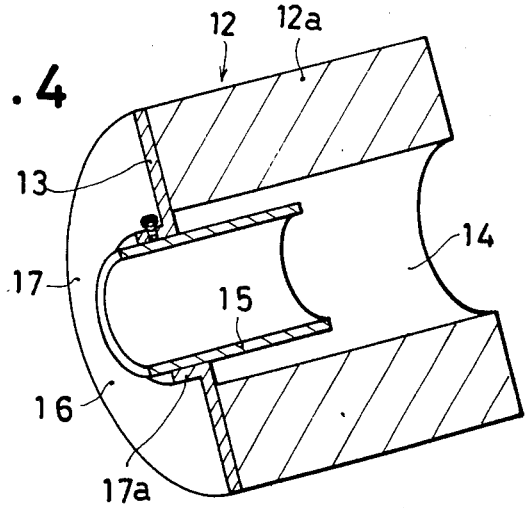
FIG. 4 is an enlarged sectional perspective view of an important portion thereof.

According to this invention, a magnet means 12 provided at the outer periphery of the operation chamber 1 is formed of a cylindrical permanent magnet **12*a* made of Ba-ferrite, Sr-ferrite or the like as shown clearly in FIG. 4. The magnet means 12 is provided at its one end 13 with a subsidiary yoke 16 having a cylindrical portion 15 extending into an inner hollow opening 14 of the permanent magnet 12*a* so that a gradient form of electron cyclotron resonance magnetic field is obtained in the operation chamber 1**.

As the permanent magnets, alnico, such rare earth compounds as samarium cobalt or the like may be used.

Figure 5:
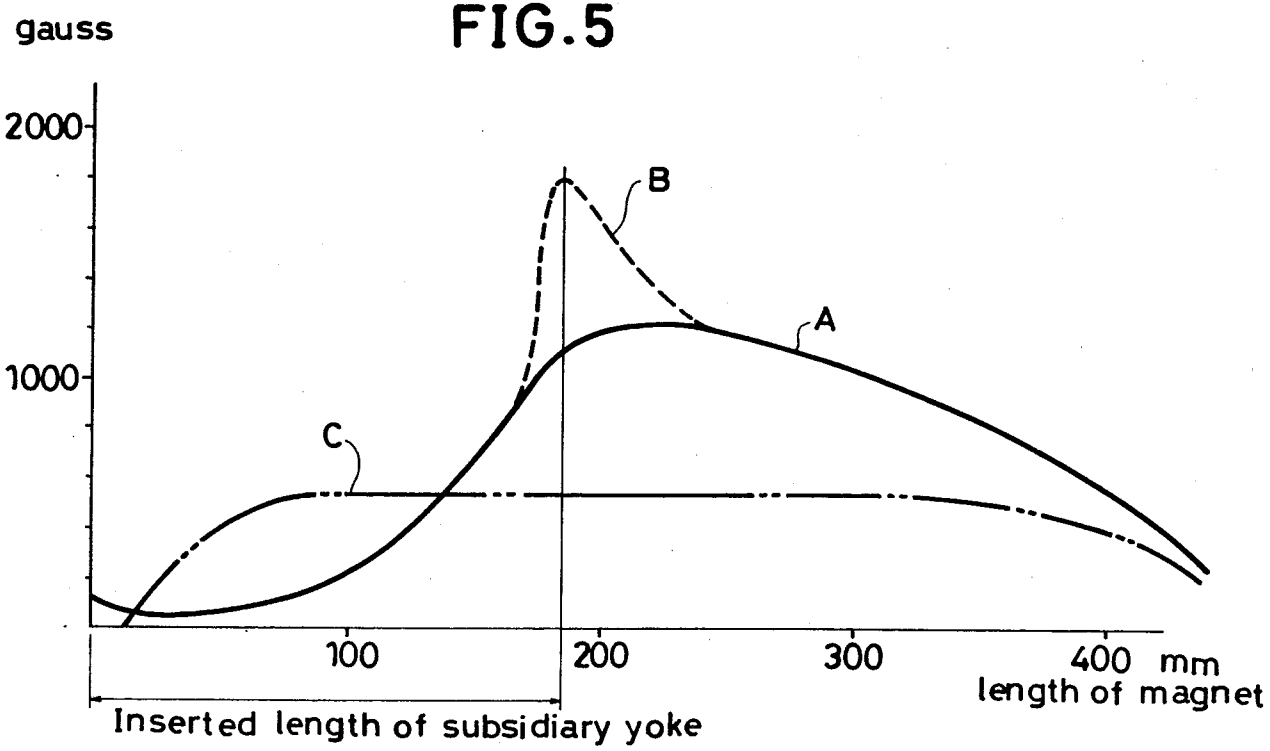
FIG. 5 is a diagram showing a magnetic field distribution characteristic curve thereof.

This will be explained more in detail with reference to one specific example thereof as follows:

In the case that the permanent magnet **12*a* is formed of a Sr-ferrite magnet which is 425 mm in length, 560 mm in outer diameter, 250 mm in inner diameter and 1249 gausses in intensity of magnetic field, and the subsidiary yoke 16 attached to the end surface 13 thereof comprises a flange portion 17 which is 560 mm in outer diameter and 10 mm in thickness and the cylindrical portion 15 is 167 mm in outer diameter, 140 mm in inner diameter and 184 mm in inserted length, the distribution of the magnetic field along the longitudinal axis of the cylindrical portion 15 becomes as shown by a curve A in FIG. 5. Namely, the magnetic field has a high intensity of about 1200 gausses at a region which is beyond the cylindrical portion 15 of the subsidiary yoke 16 and has such a gradient that the intensity thereof becomes gradually lower almost uniformly and linearly towards the outer end side corresponding to the ion outlet opening side of the operation chamber 1 until it becomes about 300 gausses at that other end side. The electron cyclotron resonance magnetic field is of about 875 gausses, and the region thereof exists in the middle portion, in the lengthwise direction, of the magnet 12*a*, and thus it is convenient in that the high magnetic field region corresponds to the middle portion of the operation chamber 1**.

In this case, there has been found a phenomenon where in the region beyond the cylindrical portion 15, an especially high magnetic field is generated as shown by a curve B in FIG. 5, at a position which is apart in the radial direction from the longitudinal axis thereof.

A curve C in FIG. 5 shows the distribution of the magnetic field along on the longitudinal axis of the cylindrical portion 15 in such a case that the subsidiary yoke 16 has been removed.

Further, in the illustrated example, the cylindrical portion 15 of the subsidiary yoke 16 is fixed with bolts or the like to an inner circumferential flange 17*a* of the flange portion 17 thereof so that the inserted length of the cylindrical portion 15 into the operation chamber 1 may be varied as desired in order to control the gradient of the magnetic field.

The operation of this embodying example will be explained as follows:

If the evacuated operation chamber 1 is charged with the reaction gas through the charging opening 11 and microwave radiation is introduced through the inlet opening 3, a plasma is generated by the action of the magnetic field, as shown by the curve A in FIG. 5, the field being formed in the operation chamber 1 by means of the surrounding permanent magnet 12*a* . The resultant ions are inducted outwards by the induction electrodes 4, 4 into the treatment chamber 6 for etching the workpiece 10. Because, during this operation, the permanent magnet 12*a* gives always the gradient magnetic field to the operation chamber 1, the prior art difficulties can be avoided.

Thus, according to this invention, the magnet means provided at the outer periphery of the operation chamber is formed of the cylindrical permanent magnet, and is provided at its one end portion with the subsidiary yoke having a cylindrical portion extending into the inner cylindrical opening thereof, so that a magnetic field is formed with a gradient. Consequently, control of an electric current as required for the case of using electromagnets can become unneccessary, and an electric power means and a cooling water means needed for the generation of the magnetic field can be eliminated.

It is readily apparent that the above-described meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A permanent magnet apparatus for an ion source providing a magnetic field having a gradient in an operating chamber into which microwaves are introduced comprising a cylindrical permanent magnet having open ends and surrounding the outer walls of an operating chamber having a hollow interior and an open inlet end and an open outlet end, and a subsidiary yoke at one of the ends of said cylindrical magnet, the subsidiary yoke having a cylindrical portion extending into but not completely contained with said cylindrical magnet at said inlet end of said operating chamber and toward said outlet end substantially one half the length of said cylindrical magnet and in axial alignment with the axis of said cylindrical magnet and said operating chamber and intermediate said cylindrical magnet and said operating chamber, the outer diameter of said yoke being smaller than the inner diameter of said cylindrical magnet and means at the operating chamber inlet end of said cylindrical magnet for supporting said yoke.

2. A magnet apparatus as claimed in claim 1, wherein the permanent magnet is made of Ba-ferrite.

3. A magnet apparatus as claimed in claim 1, wherein the permanent magnet is made of Sr-ferrite.

4. A magnet apparatus as claimed in claim 1, wherein the permanent magnet is made of alnico.

5. A magnet apparatus as claimed in claim 1, wherein the permanent magnet is made of such rare metal compounds as samarium cobalt.

6. A magnet apparatus as claimed is claim 1, wherein the operation chamber is a vacuum electric discharging chamber serving as an ion source.

7. A magnet apparatus as claimed in claim 1, wherein the subsidiary yoke comprises a flange portion and the cylindrical portion inserted through the flange portion and fixed thereto with bolts.

8. A magnet apparatus as claimed in claim 7 in which said cylindrical portion of said subsidiary yoke in said flange is adjustable for adjusting the extension of said cylindrical yoke in said cylindrical magnet toward said operating chamber outlet end.

* * * * *